United States Patent [19]

Balzer et al.

[11] Patent Number: 4,624,803

[45] Date of Patent: Nov. 25, 1986

[54] FATTY ALCOHOL OXYALKYLATES, POSSESSING BLOCKED TERMINAL GROUPS, FOR INDUSTRIAL CLEANING PROCESSES, IN PARTICULAR BOTTLE-WASHING AND METAL-CLEANING

[75] Inventors: Wolf-Dieter Balzer, Ludwigshafen; Klaus Lorenz, Worms; Helmut Wolf, Hassloch; Wolfgang Trieselt; Dieter Stoeckigt, both of Ludwigshafen; Albert Hettche, Hessheim, all of Fed. Rep. of Germany

[73] Assignee: BASF Aktiengesellschaft, Ludwigshafen, Fed. Rep. of Germany

[21] Appl. No.: 730,110

[22] Filed: May 3, 1985

[30] Foreign Application Priority Data

May 18, 1984 [DE] Fed. Rep. of Germany ..... 3418523

[51] Int. Cl.[4] ..... C11D 3/33; C11D 3/075; C11D 7/16

[52] U.S. Cl. ..... 252/527; 252/135; 252/142; 252/143; 252/156; 252/174.21; 252/DIG. 1; 252/DIG. 14; 568/601; 568/613

[58] Field of Search ..... 252/135, 174.21, 174.22, 252/99, DIG. 1, 156, 527, 143, DIG. 14, 142; 568/601, 613

[56] References Cited

U.S. PATENT DOCUMENTS

| | | | |
|---|---|---|---|
| 2,841,621 | 7/1958 | Riley | 252/156 |
| 3,444,242 | 5/1969 | Rue et al. | 252/156 |
| 3,956,401 | 5/1976 | Scardera et al. | 252/170 |
| 4,252,540 | 2/1981 | Yamamura et al. | 44/51 |
| 4,340,766 | 7/1982 | Klahr et al. | 568/625 |
| 4,364,777 | 12/1982 | Grünert et al. | 134/29 |
| 4,366,326 | 12/1982 | Vodrazka et al. | 568/613 |
| 4,375,565 | 3/1983 | Greif et al. | 568/622 |
| 4,390,465 | 6/1983 | Sperman | 252/527 |
| 4,418,217 | 11/1983 | Schmid et al. | 568/593 |
| 4,443,363 | 4/1984 | Klinger et al. | 252/547 |
| 4,548,729 | 10/1985 | Schmid et al. | 252/174.21 |

FOREIGN PATENT DOCUMENTS

| | | |
|---|---|---|
| 2531407 | 1/1976 | Fed. Rep. of Germany . |
| 3315951 | 11/1984 | Fed. Rep. of Germany . |
| 1445716 | 8/1976 | United Kingdom . |

*Primary Examiner*—Prince E. Willis

*Attorney, Agent, or Firm*—Oblon, Fisher, Spivak, McClelland & Maier

[57] ABSTRACT

Fatty alcohol oxyalkylates possessing blocked terminal groups are used as low-foam, antifoaming and biodegradable surfactants for industrial cleaning processes, in particular for bottle-washing and metal-cleaning.

5 Claims, No Drawings

FATTY ALCOHOL OXYALKYLATES, POSSESSING BLOCKED TERMINAL GROUPS, FOR INDUSTRIAL CLEANING PROCESSES, IN PARTICULAR BOTTLE-WASHING AND METAL-CLEANING

The present invention relates to the use of fatty alcohol oxyalkylates, possessing blocked terminal groups, as low-foam, antifoaming and biodegradable surfactants for industrial cleaning processes, in particular bottle-washing and metal-cleaning.

Highly alkaline cleaners are used for cleaning bottles in the beverage industry. The alkali dissolves, neutralizes or hydrolyzes residual beverage and residues and converts the label glue to a highly foaming water-soluble form. All of these processes take place with a large amount of mechanical energy and therefore favor the tendency of starch and of sugar degradation products to foam, a tendency which in any case is high.

For this reason, these cleaning operations require surfactants which not only produce very little foam themselves but also are stable under the highly alkaline conditions, ie. they should not become discolored or produce any foaming degradation products, as, for example, prior art non-ionic surfactants are known to do. Another important requirement is that such surfactants must possess antifoaming properties with respect to the foam promoters formed from the residual beverage and glue under cleaning conditions, as a result of treatment with alkali. A further requirement is dispersing properties on the labels entrained by, for example, the goods being washed.

Another application comprises industrial cleaning processes in the metal industry. In this case, too, an aqueous alkaline solution possessing very good wetting properties is employed, under high pressure, as the cleaning medium for removing drawing grease and neck grease or carboxyl-containing organic corrosion inhibitors. In this case, the novel surfactants should not only improve the wetting properties but in particular contribute to inhibiting foaming of, for example, anionic surfactants of the alkylbenzenesulfonate type or other sulfo-containing and carboxyl-containing surfactants.

These desirable properties are possessed by, for example, a class of non-ionic surfactants which are generally referred to as ethylene oxide/propylene oxide block polymers. They are described in U.S. Pat. No. 2,674,619. Particularly advantageous block polymers of this type are those for which the initiating molecule for the polymeric surfactant is an amine compound. These surfactants produce little foam and have good dispersing power. Compared with standard surfactants, they are high molecular weight compounds which possess a polyether structure and are known to have particularly specific properties with regard to dispersing and foam inhibition. However, these non-ionic surfactants which are specially tailored to industrial cleaning processes have the serious disadvantage that they are not sufficiently biodegradable according to the test methods required by the Detergent Act for surface-active compounds.

There is a large number of patent applications concerned with the provision of biodegradable low-foam surfactants.

For example, European Pat. No. 34,275 also relates to low-foam, antifoaming surfactants for industrial cleaning processes. However, this class of substances, which comprises oxyethylated and subsequently oxybutylated aliphatic alcohols, has the disadvantage of tending to become discolored under alkaline conditions, and of losing their antifoaming properties after prolonged use and beginning to foam themselves. Furthermore, they have only a moderate antifoaming effect on alkylbenzenesulfonates.

European Patent Application No. 8,010,249.1 describes low-foam surfactants which have a low degree of oxyalkylation and are likewise biodegradable. Compared with the novel products, however, these products lose their low-foam, antifoaming properties very rapidly when they are stored, or tested for a fairly long period, in the presence of an alkali at elevated temperatures.

European Pat. No. 36,550 discloses that the terminal groups of oxyalkylated fatty alcohols containing an alkyl radical of 8 to 20 carbon atoms and from 4 to 30 alkylene oxide units can be blocked by propylene. These surfactants are said to produce little foam and should be stable to alkali and especially to acids. These surfactants, where they are ethylene oxide/propylene oxide copolymers, do not have an optimum action in practice, especially since they are not sufficiently biodegradable. The relatively complicated and expensive method of preparation is a disadvantage, preventing them from being used in industry.

The skilled worker is familiar with the fact that the production of little foam, foam inhibition and stability to alkali on the one hand and biodegradability as required by the German Detergent Act and the associated regulation on the other hand are contrary requirements The degree of difficulty encountered, for example by the industrial metal cleaning and the bottle-washing sectors, in obtaining surfactants which conform to the Act and whose performance characteristics are also acceptable is reflected in the fact that the provisional regulation for this class of surfactants has now been extended for the second time, to 1986.

It is an object of the present invention to provide industry with a non-ionic surfactant which meets the desired requirements, in particular for industrial cleaning processes.

We have found that this object is achieved if non-ionic surfactants of the formula I $$R—O—(X_1)_n—(X_2)_m—(X_3)_p—Z$$

where R is alkyl of 8 to 22 carbon atoms, $X_1$ and $X_3$ are each an ethylene oxide unit, n and p are each from 0 to 10 and the sum of n and p is not less than 2, preferably not less than 5 and not more than 9, $X_2$ is a propylene oxide or butylene oxide unit, m is from 1 to 5, preferably from 2 to 4, and Z is methyl, ethyl or allyl, are used as low-foam, antifoaming and biodegradable surfactants in industrial cleaning processes, in particular bottle-washing and metal-cleaning.

Surprisingly, the special compounds of the formula I have a good antifoaming effect, although the skilled worker is familiar with the fact that little foam inhibition can be achieved by blocking terminal groups with methyl. They produce little foam and can be classified as satisfactorily biodegradable in accordance with the provisions in the Federal Law Gazette of Jan. 30, 1977, part 1, page 244 et seq.

Radicals R are particularly preferably alkyl radicals of 10 to 18 carbon atoms, very particularly radicals based on $C_{13}/C_{15}$-oxoalcohols and $C_{10}/C_{14}$ Ziegler alcohols, where p is 0, n is from 5 to 9 and m is from 2 to 4, whose terminal group is blocked by methyl, and mixtures of these surfactants.

In conformity with the definition, starting materials for the preparation of the surfactants used according to the invention are fatty alcohols of 8 to 22 carbon atoms, or mixtures of these. They can be branched or straight-chain, preferred fatty alcohols being straightchain, or branched only to a small degree. Compounds of this type are alcohols, such as octanol, nonanol, decanol, dodecanol, tetradecanol, hexadecanol or oxadecanol (stearyl alcohol), and mixtures of these. Those obtained by the Ziegler synthesis or the oxo synthesis are particularly preferred industrially. These are mixtures of alcohols of 9/11, 13/15 or 16/18 carbon atoms, the mixtures being prepared by the oxo synthesis. The mixtures of alcohols of 8/10, 10/12, 12/16 and 16/20 carbon atoms, which mixtures are obtained by the Ziegler synthesis, are also advantageous. The $C_{13}/C_{15}$ cut of the alcohol fraction obtained by the oxo synthesis is particularly advantageous.

The alcohol oxyalkylates are prepared in a conventional manner, and the oxyalkylates obtained are then converted to the corresponding ethers with an alkylaating agent. The process as for the preparation of these surfactants are known from the literature and do not require a general description. The specific preparation of some selected compounds is treated in the Examples.

The Examples which follow illustrate the invention without restricting it.

Preparation Examples

EXAMPLE 1

20.8 parts of $C_{13}/C_{15}$ oxoalcohol and 0.1 part of potassium hydroxide were initially taken in an autoclave, 26.4 parts of ethylene oxide gas were passed in continuously at from 110° to 120° C., and the reaction was completed by stirring for a further hour. 23.2 parts of propylene oxide were then added continuously at from 130° to 140° C., and the reaction was allowed to continue for 2 hours. 70 parts of a fatty alcohol oxyalkylate having an OH number of from 85 to 88 and a turbidity point, according to DIN No. 53,917, of 31° C. in water were obtained.

An equimolar amount of KOH was added to 19 parts of the resulting fatty alcohol oxyalkylate at room temperature, and the said oxyalkylate was converted to the alcoholate. Etherification was then carried out using 4.45 parts of dimethyl sulfate, and the inorganic reaction products were separated off from the end product by extraction with water. This process was repeated several times until the OH number of the end product was ≦8. The residual water was removed by distillation under reduced pressure, and salt residues were removed by filtration.

17 parts of a surfactant possessing blocked terminal groups and having an OH number of 7 were obtained. Residual water determined by the Karl Fischer method was about 0.3%. The turbidity point of a 2% strength solution in 25% strength butylene diglycol was 68°-69° C.

The following surfactants used according to the invention and shown in Table 1 were prepared in a similar manner, and, depending on the meaning of Z, dimethyl sulfate, diethyl sulfate, allyl chloride or benzyl chloride was used in the reaction as the alkylating agent. The products with blocked terminal groups had a residual OH number of <15, preferably ≦8.

TABLE 1

| Example | R | $(X_1)_n$ | $(X_2)_m$ | $(X_3)_p$ | Z | Residual OH number | Turbidity point °C. (2% strength in 25% strength BDG)* |
|---|---|---|---|---|---|---|---|
| 1 | $C_{13-15}$-oxo-alkyl | $(C_2H_4O)_6$ | $(C_3H_6O)_4$ | — | $CH_3$ | 7 | 68-69 |
| 2 | $C_{13-15}$-oxo-alkyl | $(C_2H_4O)_5$ | $(C_3H_6O)_4$ | — | $CH_3$ | 7 | 64 |
| 3 | $C_{13-15}$-oxo-alkyl | $(C_2H_4O)_5$ | $(C_3H_6O)_3$ | — | $CH_3$ | 8.5 | 66 |
| 4 | $C_{13-15}$-oxo-alkyl | — | $(C_3H_6O)_4$ | $(C_2H_4O)_2$ | $CH_3$ | 10 | 70-71 |
| 5 | $C_{13-15}$-oxo-alkyl | $(C_2H_4O)_6$ | $(C_3H_6O)_4$ | — | allyl | 8 | 64-65 |
| 6 | $C_{16-18}$-alkyl | $(C_2H_4O)_8$ | $(C_3H_6O)_4$ | — | $CH_3$ | 1 | 64 |
| 7 | $C_{10-12}$-Ziegler-alkyl | $(C_2H_4O)_5$ | $(C_3H_6O)_3$ | — | $CH_3$ | 3.3 | 70-71 |
| 8 | $C_{10-12}$-Ziegler-alkyl | $(C_2H_4O)_5$ | $(C_3H_6O)_3$ | — | $C_2H_5$ | 5.3 | 68 |
| 9 | $C_{10-12}$-Ziegler-alkyl | $(C_2H_4O)_5$ | $(C_3H_6O)_3$ | — | allyl | 4 | 69-70 |
| 10 | $C_{13-15}$-oxo-alkyl | $(C_2H_4O)_9$ | $(C_4H_8O)_2$ | — | $CH_3$ | 12 | 68 |
| 11 | $C_{13-15}$-oxo-alkyl | $(C_2H_4O)_6$ | $(C_4H_8O)_2$ | — | $CH_3$ | 7.6 | 61 |

*Butylene diglycol

The surfactants used according to the invention provide optimum properties in respect of the production of a small amount of foam, foam inhibition and stability to alkali, coupled with a biodegradability of not less than 80%, in accordance with the above legal provision.

The surfactants used according to the invention are preferably employed, for example, in industrial liquid and powder cleaner formulations for bottle-washing and metal-cleaning as required in metalworking. The present invention therefore furthermore relates to cleaner formulations which contain not only conventional constituents but also the novel surfactants.

The following general formulation of a powder cleaner serves as an example of a formulation for bottle-washing, relatively small amounts of the surfactant used according to the invention being sufficient, owing to the good wetting action:

from 10 to 30% by weight of NaOH,
from 10 to 40% by weight of Na metasilicate,
from 10 to 40% by weight of pentasodium triphosphate,
from 5 to 20% by weight of the complex former of the ethylenediaminetetraacetic acid or nitrilotriacetic acid type and
from 5 to 10% by weight of a novel surfactant.

The following is a suitable composition for a general formulation for a liquid cleaner:

from 10 to 30% by weight of the novel surfactant,
from 5 to 30% by weight of phosphonic acid,
from 15 to 30% by weight of phosphoric acid,
from 0 to 10% by weight of isopropanol and
water to make up to 100% by weight.

This formulation is used by metering it, advantageously in an amount of from 0.3 to 1 kg/m$^3$, into a cleaning bath which contains from 0.5 to 3% by weight of sodium hydroxide.

To test the alkali stability of the novel surfactants in the above formulation and under cleaning conditions, 30 g of surfactant are stored over 3 g of solid NaOH for 2 weeks at 50° C.

Under these severe conditions, the surfactant solution must not become discolored, and the foam-forming and in particular the antifoaming properties should not be reduced as a result.

Testing for foam formation is carried out by the beating method (DIN No. 53,902, sheet 1), modified so that a perforated disk with 22 openings and a beating cylinder of 1,500 ml capacity are employed and the material is beaten 20 times. The foam behavior is based on a measurement of the foam height after 30 sec.

According to this DIN method, the foam volume of the sample solution is denoted by $V_2$ and stated in ml. $V_s$ is the foam volume expressed as a percentage of the foam volume of the comparative solution.

For further characterization, the wetting power is tested according to DIN No. 53,001, at 20° C. in distilled water containing 2 g/l of sodium carbonate. The wetting power provides information about the performance characteristics in the above applications. The wetting power and the antifoaming action on foreign substances, as well as the inherent foaming power, are frequently contrary properties. Good antifoams are usually poor wetting agents, and good wetting agents frequently exhibit very pronounced foaming.

In accordance with the variety of applications, on the one hand the antifoaming behavior is tested in a dishwasher in the presence of protein (egg test), while on the other hand the antifoaming action on alkylbenzenesulfonates is investigated in a dynamic foam apparatus.

Egg test:

The number of revolutions of a washing arm in an automatic dishwasher is determined by a magnetic induction measurement, with the aid of a counter. The number of revolutions of the washing arm is reduced as a result of foam formation, which takes place in particular in the presence of proteins (albumin). Because of the reduced reaction force, the number of revolutions is thus a measure of the suitability of surfactants in cleaning apparatuses operating with a large amount of mechanical activity.

The test time is 12 minutes, the number of revolutions per minute being calculated from the total number of revolutions after particular periods. The washing process is begun at room temperature; after about 10 minutes, the temperature of the washing water is 60° C.

The antifoaming action on an alkylbenzenesulfonate in a dynamic foam apparatus is another laboratory method for investigating the antifoaming behavior in the presence of anionic surfactants. The test apparatus is a continuous through-circulation apparatus. Foam formation is effected by a method in which a test jet flows continuously, under constant pressure, into the initially taken solution in a calibrated tube of 6 cm diameter. The resulting product-specific foam height is measured in ml. If a foam booster, for example in the form of an alkylbenzenesulfonate, is added to this test solution, the antifoaming behavior of the novel antifoaming surfactants can be investigated.

Table 2 shows the amount of foam for 6 ml, 12 ml and 18 ml of 2.5% strength alkylbenzenesulfonate solution when 0.3 g/l of test surfactant is employed, ie. the smaller the amount of foam, the greater is the potential inhibiting power of the surfactant.

TABLE 2

| Use Example | Product of Example from Table 1 | Foam test DIN 53,902 | | Egg test (rpm) | Wetting power(s) 20° | | | Foam/ml in dynamic foam apparatus | | |
|---|---|---|---|---|---|---|---|---|---|---|
| | | $V_2$ | $V_s$ | G 7735 | 0.5 g/l | 1 g/l | 2 g/l | 6 ml* | 12 ml* | 18 ml* |
| 12 | 1 | 20 | 4 | 82 | 100 | 30 | 12 | 10 | 100 | 320 |
| 13 | 5 | 10 | 2 | 94 | 154 | 67 | 23 | 10 | 90 | 230 |
| 14 | 2 | 20 | 4 | 82 | 218 | 110 | 45 | 30 | 90 | 250 |
| 15 | 3 | 30 | 6 | 76 | 112 | 50 | 16 | 20 | 80 | 240 |
| 16 | 4 | 10 | 2 | 89 | >300 | 226 | 130 | 70 | 150 | 290 |
| 17 | 6 | 10 | 2 | 84 | 265 | 139 | 58 | 20 | 270 | 350 |
| 18 | 7 | 10 | 2 | 54 | 88 | 37 | 13 | 30 | 180 | 350 |
| 19 | 8 | 10 | 2 | 61 | 105 | 87 | 30 | 20 | 100 | 230 |
| 20 | 9 | 0 | 0 | 65 | 136 | 82 | 44 | 40 | 130 | 320 |
| 21 | 10 | 10 | 2 | 102 | 86 | 29 | 11 | 10 | 40 | 300 |
| 22 | 11 | 10 | 2 | 82 | 162 | 67 | 27 | 0 | 30 | 170 |

*After the addition of 6 ml, 12 ml and 18 ml of 2.5% strength alkylbenzenesulfonate solution The results from Table 2 show that, in the foam test according to DIN No. 53,902, all of the products investigated form virtually no foam. The egg test in a Miele dishwasher (type G 7735) is more closely related to practice and shows differentiation in the antifoaming properties with respect to albumin foam, values above 80 indicating excellent foam inhibition.

The values for the wetting power, which are less than 265 for the vast majority of surfactants investigated, show that even products possessing good antifoaming properties can produce excellent wetting effects.

The foam-inhibition values measured in a dynamic foam apparatus indicate that the surfactants investigated have a very high antifoaming capacity. These results are particularly important with regard to practical application. Such advantageous values were obtained to date only with non-biodegradable surfactants.

Very particularly noteworthy is the stability of the novel surfactants in the above test for stability to alkali (30 g of surfactant, 3 g of solid NaOH, 2 weeks, 50° C.). After storage for 2 weeks over solid sodium hydroxide, the values or surfactant properties shown in Table 2 are virtually unchanged.

We claim:

1. A liquid cleaner for industrial bottle washing, which comprises from 5 to 30% by weight of phosphonic acid,
from 15 to 30% by weight of phosphoric acid,
from 0 to 10% by weight of isopropanol,
from 10 to 30% by weight of a non-ionic surfactant having the formula 1

$$R—O—(X_1)_n—(X_2)_m—Z$$

where R is alkyl group having from 10 to 18 carbon atoms, $X_1$ is an ethylene oxide unit, n is 5 to 7, $X_2$ is a propylene oxide or butylene oxide unit, m is 2 to 4, and Z is methyl, ethyl or allyl, and water to make up 100% by weight.

2. A powder cleaner for industrial bottle washing, which comprises 10 to 30% by weight of NaOH, 10 to 40% by weight of sodium metasilicate, 10 to 40% by weight of pentasodium triphosphate, 5 to 20% by weight of ethylenediaminetetraacetic acid or nitrilotriacetic acid, and from 5 to 10% of a non-ionic surfactant having the formula 1:

$$R—O—(X_1)_n—(X_2)_m—Z$$

wherein R is an alkyl group of from 10 to 18 carbon atoms, $X_1$ is an ethylene oxide unit, n is 5 to 7, $X_2$ is a propylene oxide or butylene oxide unit, m is 2 to 4, and Z is methyl, ethyl or allyl.

3. A method for industrial bottle washing, which comprises contacting a bottle to be washed with a powder cleaner, which comprises 10 to 30% by weith of NaOH, 10 to 40% by weight of sodium metasilicate, 10 to 40% by weight of pentasodium triphosphate, 5 to 20% by weight of ethylenediaminetetraacetic acid or nitrilotriacetic acid, and from 5 to 10% of a non-ionic surfactant having the formula 1:

$$R—O—(X_1)_n—(X_2)_m—Z$$

wherein R is an alkyl group of from 10 to 18 carbon atoms, $X_1$ is an ethylene oxide unit, n is 5 to 7, $X_2$ is a propylene oxide or butylene oxide unit, m is 2 to 4, and Z is methyl, ethyl or allyl.

4. A method for industrial bottle washing, which comprises contacting a bottle to be washed with a liquid cleaner, which comprises from 5 to 30% by weight of phosphonic acid, from 15 to 30% by weight of phosphoric acid, from 0 to 10% by weight of isopropanol, from 10 to 30% by weight of a non-ionic surfactant having the formula 1:

$$R—O—(X_1)_n—(X_2)_m—Z$$

where R is alkyl group having from 10 to 18 carbon atoms, $X_1$ is an ethylene oxide unit, n is 5 to 7, $X_2$ is a propylene oxide or butylene oxide unit, m is 2 to 4, and Z is methyl, ethyl or allyl, and water to make up 100% by weight.

5. A method according to claims 3 or 4, wherein in formula 1, R is a radical of a $C_{13}/C_{15}$-oxoalcohol or a $C_{10}/C_{14}$ Ziegler alcohol, $X_1$ is an ethylene oxide unit, n is from 5 to 7, $X_2$ is a propylene oxide or butylene oxide unit, m is from 2 to 4, and Z is methyl, ethyl or allyl.

* * * * *